US005459008A

United States Patent [19]

Chambers et al.

[11] Patent Number: 5,459,008

[45] Date of Patent: Oct. 17, 1995

[54] METHOD AND APPARATUS FOR TONER RELEASE FROM TRANSFER MEMBER TO PAPER

[75] Inventors: John S. Chambers, Rochester; John S. Berkes, Webster; Timothy J. Fuller, Pittsford, all of N.Y.

[73] Assignee: Xerox Corporation, Stamford, Conn.

[21] Appl. No.: 268,386

[22] Filed: Jun. 29, 1994

[51] Int. Cl.[6] ..... G03G 13/16; G03G 15/16

[52] U.S. Cl. ..... 430/126; 430/47; 355/273

[58] Field of Search ..... 430/110, 126, 430/47; 355/273

[56] References Cited

U.S. PATENT DOCUMENTS

| | | | |
|---|---|---|---|
| 4,478,923 | 10/1984 | De Roo et al. | 430/110 |
| 4,814,253 | 3/1989 | Gruber et al. | 430/138 X |
| 4,868,086 | 9/1989 | Ohtani et al. | 430/110 X |
| 4,968,578 | 11/1990 | Light et al. | 430/126 |
| 5,110,702 | 5/1992 | Ng et al. | 430/126 X |

*Primary Examiner*—Roland Martin
*Attorney, Agent, or Firm*—Oliff & Berridge

[57] ABSTRACT

Complete toner transfer from the surface of an intermediate transfer member of an electrostatic printing machine to an image receiving substrate such as paper that can range in gloss from low to very high is accomplished by the use of a thin film coating of a release agent material upon the surface of the intermediate transfer member or by the incorporation of a release agent material onto or into toner particles.

18 Claims, No Drawings

METHOD AND APPARATUS FOR TONER RELEASE FROM TRANSFER MEMBER TO PAPER

FIELD OF THE INVENTION

This invention relates to the improved release of toner images from an intermediate transfer member to an image receiving substrate such as paper, and especially relates to release of toned images from an intermediate transfer member to high gloss substrates.

BACKGROUND

In a typical electrostatographic printing machine (such as a photocopier, laser printer, facsimile machine or the like), an imaging member is employed and is exposed to an image to be printed. Exposure of the imaging member to the image to be printed records an electrostatic latent image on the imaging member corresponding to the informational areas contained within the image to be printed. Generally, the electrostatic latent image is developed by bringing a toner or developer mixture into contact therewith.

One type of developer used in such printing machines is a liquid developer comprising a liquid carrier having toner particles dispersed therein. Generally, the toner is made up of resin and a suitable colorant such as a dye or pigment. Conventional charge director compounds may also be present. The liquid developer material is brought into contact with the electrostatic latent image and the colored toner particles are deposited thereon in image configuration.

The developed toner image recorded on the imaging member is transferred to an image receiving substrate such as paper via an intermediate transfer member. The toner particles may be transferred by heat and/or pressure to an intermediate transfer member, or more commonly, the toner image particles may be electrostatically transferred to the intermediate transfer member by means of an electrical potential between the imaging member and the intermediate transfer member. After the toner has been transferred to the intermediate transfer member, it is then transferred to the image receiving substrate, for example by contacting the substrate with the toner image on the intermediate transfer member under heat and/or pressure.

Intermediate transfer members enable high throughput at modest process speeds. In four-color photocopier systems, the intermediate transfer member also improves registration of the final color toner image. In such systems, the four component colors of cyan, yellow, magenta and black may be synchronously developed onto one or more imaging members and transferred in registration onto an intermediate member at a transfer station.

In electrostatographic printing machines in which the toner image is transferred from the intermediate transfer member to the image receiving substrate, it is important that the transfer of the toner particles from the intermediate transfer member to the image receiving substrate be as close as possible to 100%. Less than complete transfer to the image receiving substrate results in image degradation and low resolution. Completely efficient transfer is particularly important when the imaging process involves generating full color images since undesirable color deterioration in the final colors can occur when the color images are not completely transferred from the intermediate transfer member.

Thus, it is important that the intermediate transfer member surface has excellent release characteristics with respect to the toner particles. Conventional materials known in the art for use as intermediate transfer members often possess the strength, conformability and electrical conductivity necessary for use as intermediate transfer members, but can suffer from poor toner release characteristics, especially with respect to higher gloss image receiving substrates.

A need remains for an intermediate transfer member that exhibits substantially 100% toner transfer, without system failure, to image receiving substrates having glosses ranging from low to very high. Further, a need remains for a method for producing high resolution images upon image receiving substrates having various glosses from such an intermediate transfer member.

SUMMARY OF THE INVENTION

This invention provides a method, applicable to both conventional and transfuse processes, of producing high resolution images upon an image receiving substrate, such substrate that can have a gloss ranging from low to very high, with substantially 100% transfer from an intermediate transfer member with respect to the toner particles of a liquid developer as assisted by the use of release agent materials.

According to the invention, release agent materials are either incorporated into or coated onto conventional toner particles or applied as a thin film coating to the surface of an intermediate transfer member. The present invention also provides an intermediate transfer member that exhibits substantially 100% toner transfer release to an image receiving substrate over a broad range of substrate glosses, and also provides a toner for use in a liquid developer that exhibits excellent release from an intermediate transfer member surface to an image receiving substrate.

DETAILED DESCRIPTION OF PREFERRED EMBODIMENTS

Intermediate transfer members need to be comprised of a material that has good dimensional stability, is resistant to attack by materials of the toner or developer, is conformable to an image receiving substrate such as paper and is preferably electrically semiconductive. Conventional materials known in the art as useful for intermediate transfer members include rubbers, fluorocarbon elastomers such as are available under the Viton® tradename from E. I. du Pont de Nemours & Co., polyvinyl fluoride such as available under the tradename Tedlar®, also available from E. I. du Pont de Nemours & Co, etc.

The intermediate transfer member may take the form of a sheet, a belt or a roller or other suitable shape. Further, the intermediate transfer member may be in the form of a single layer, or the intermediate transfer member material may be coated upon a thermally conductive and electrically semiconductive substrate, although under some conditions electrically conductive substrates may be used. Examples of suitable substrate materials include but are not limited to polyamides, stainless steel and numerous metallic alloys.

In an electrostatographic printing machine, each image being transferred is formed on an imaging member. The imaging member can take conventional forms such as a photoreceptor belt or drum, an ionographic belt or drum, etc. The image may then be developed by contacting the latent image with a toner or developer at a developing station. The development system can be either wet or dry. The developed image is then transferred to an intermediate transfer member. The image can be either a single image or a multi-image. In a multi-image system, each of the images may be formed on the imaging member and developed sequentially and then transferred to the intermediate transfer member, or in an alternative method, each image may be formed on the imaging member, developed, and transferred in registration to the intermediate transfer member.

The multi-image system can also be a color copying system. In the color copying system, each color of an image being copied may be formed on the imaging member. Generally, cyan, yellow, magenta and black are the four toner colors used in such color copying systems. Each of these color images is developed and transferred to the intermediate member, such as by the above-described processes. Further, each color image may be exposed and developed in each of four separate imaging members and developing machines, as disclosed in Berkes et al., U.S. Pat. No. 5,119,140, herein incorporated by reference in its entirety.

After the latent image is formed on the imaging member and the image has been developed, the developed toner image is transferred to the intermediate transfer member. Transfer is most often effected by electrostatic means, in which the intermediate transfer member is given an opposite charge from that of the toner particles. Known mechanisms for charging the intermediate transfer member include biased transfer rollers and corona discharge devices. Of course, toner transfer can also be accomplished by heat and/or pressure; for example, a heated pressure roller may bring the developed toner image and the intermediate transfer member into contact. Such heat and/or pressure transfer, however, is less preferred as it is less efficient in toner transfer.

The intermediate transfer member may carry the toner image into contact with an image receiving substrate under heat and/or pressure to transfer and fix the toner image to the image receiving substrate. A fuser roller may be utilized to supply the requisite heat and pressure. Alternatively, the intermdiate and the toner can be heated prior to contacting the paper and the application of pressure. The image receiving substrate with the image thereon is then transported to an output tray.

In the above described printing process, the toner particles may be supplied in a liquid developer. Such liquid developers comprise toner particles disposed within a liquid carrier. The toner particles generally comprise a suitable resin such as polyethylene-methacrylic acid and colorant in the form of a dye or pigment. The liquid carrier conventionally comprises a solvent such as Isopar® (branched aliphatic hydrocarbons available from Exxon Chemical Corporation) or Norpar® (high purity normal paraffinic liquids available from Exxon Chemical Corporation) or other hydrocarbon liquids. The liquid developer and toner particles can also include known adjuvants such as charge control agents, charge directors, surfactants for improved dispersion, and plasticizers. The toner particles must be able to carry a charge so as to be capable of electrostatic transfer in the printing machine.

The image receiving substrate can be, for example, paper or transparent plastic. The image receiving substrate is often paper. Paper comes in a large variety of surface glosses. In order of low surface gloss to high surface gloss, examples of such papers include Xerox ISLX 24#, Frostbrite Matte 70#(Consolidated Paper Co.), Productolith Dull 70#(Consolidated Paper Co.), Simpson Coated 1 Side 70#(Simpson), Productolith Gloss 70#(Consolidated Paper Co.), Centura Gloss 70#(Consolidated Paper Co.), Lustrogloss 70#(S. D. Warren), and Kromekote 100#(Champion Paper Co.). All of these papers with the exception of Xerox ISLX are coated with formulations propietary to each manufacturer. The papers have gloss levels which range from 10 Gardner gloss units for ISLX to 80 Gloss units for the Centura Gloss, Lustrogloss and Kromekote papers. Transparent plastics have very high glosses. An example of such a transparent plastic is Mylar® (a polyester).

Conventional intermediate transfer member materials may possess excellent strength, conformability to an image receiving substrate, and good conductivity, but do not always possess adequate release necessary to achieve substantially 100% toner particle transfer to an image receiving substrate. This is especially true for fluoroelastomers such as Viton®. Less than complete release is especially profound when transferring toner particles to substrates having high gloss. Less than 100% toner transfer results in poor images as well as image and color degradation. With some coated papers of very high gloss such as Kromekote, catastrophic failure has been observed with the use of conventional intermediate transfer materials in that the coating on the paper transfers to the intermediate transfer member surface rather than having the toner image transfer to the paper substrate. Such catastrophic failure can result in having to replace the intermediate transfer member.

By this invention, it has been found that the use of a release agent material improves the toner transfer efficiency of an intermediate transfer member surface to an image receiving substrate to substantially 100% across a broad range of image receiving substrate glosses. Further, the use of a release agent material can entirely eliminate such catastrophic failure with respect to coated image receiving substrates.

Preferably, the release agent material comprises polyolefins (waxes and polymers) such as polyethylene, fluorinated polymers such as Teflon® (a polytetrafluoroethylene) or Fluoroglide®, silicone polymers and oligomers such as polydimethylsiloxane, and polymers with grafts of the above polymers, and mixtures thereof.

If the release agent material is a polyolefin, a 1-olefin polymer of the formula $[—CH_2—CH_2—\{(CH_2)_x—CH_3\}—]_n$ where x=2, 12, 13, 15, 17 and ≧27 and n refers to the repeat unit specified and can range from 25–100,000, or a copolymer thereof, is preferred.

The release agent material may be coated as a thin film on the surface of the intermediate transfer member or incorporated into or on the toner particles in the liquid developer.

In a first embodiment, the release agent material is coated onto the surface of an intermediate transfer member as a thin film. The release agent thin film coating is not a part of the transfer member structure, but is instead a separate coating on top of a formed intermediate transfer member. That is, the release agent material is coated upon the intermediate transfer member surface that is comprised of a material having good dimensional stability, resistance to attack by materials of the toner or developer, conformability to an image receiving substrate and preferably electrical semiconductivity. The film may be continuous. The film preferably has a thickness of 100 to 10,000 Angstroms (0.01 to 1 micron).

The intermediate transfer member can be replaced when the release agent film has degraded to an extent to become ineffective. Preferably, however, an applicator is provided in the printing machine to either continuously or intermittently apply a thin film of the release agent material to the intermediate transfer member surface. Such an applicator can comprise an application brush such as described in copending U.S. application Ser. No. 08/267,738 (JAO 29071) filed simultaneously herewith, the entire disclosure of which is herein incorporated by reference. The release agent material also may be applied as a spray, such as an aerosol or non-aerosol spray, for example. The release agent thin film coating may allow for 100% toner particle release from the surface of the intermediate transfer member to an image receiving substrate of any gloss.

In a second embodiment of this invention, the release agent material is incorporated into toner particles used in a liquid developer. The release agent material can be incorporated into the toner particles by admixing the release agent material with a resin, dye or pigment in a conventional toner particle formation process. Also, formed toner particles can be surface treated with the release agent material to form an adherent coating upon the toner particles. Further, liquid developers can include particles that incorporate the release agent material along with conventional toner particles. The release agent material may be added to toner particles in an amount between 4 and 50 wt. % and preferably between 4 and 10 wt. % of the toner particle and release agent material.

As toner particle forming processes are conventional and well ordinary skill in the art. Reference is made to U.S. Pat. No. 5,243,392, herein incorporated by reference in its entirety, as illustrative of toner particle formation processes.

If the release agent material is to be incorporated into the toner particle, it may, for example, be admixed with the pigment or dye and other conventional toner particle additives prior to sizing into the final toner particle. Suitable toner particles may have a size in the range of about 1 micrometer to about 20 micrometers, for example. If the release agent material is to be coated onto the toner particle, any known surface treating process can be utilized, including but not limited to dip coating, spray coating, etc.

The addition of the release agent material to the toner particles can yield the same release properties for the toner particles with respect to the intermediate transfer member surface as using a thin film of release agent material directly upon the intermediate transfer member surface. Thus, incorporating the release agent material into or on the toner particle allows for substantially 100% toner particle release from the intermediate transfer member surface to an image receiving substrate of any gloss.

The toner particle transfer of the image to an image receiving substrate of various glosses is demonstrated in the following examples.

EXAMPLE 1

In this example, the toner is a conventional toner of Nucrel 599 polyethylene-10-wt. %-methacrylic acid (available from E. I. DuPont de Nemours & Co.) in a liquid developer carrier of Isopar-L (an aliphatic hydrocarbon available from Exxon Chemical Corporation) and Norpar. The toner solids density is 0.2 mg/cm$^2$.

As the image receiving substrate, eight different papers of varying gloss were used. The results in Table 1 list the substrates in order of low gloss to high gloss. The ISLX paper has no surface coating. All of the the other papers have surface coatings propietary to each manufacturer.

In the transfer process, the toner particles are transferred from the intermediate transfer member surface to the paper substrate under a nip pressure of 220 psi, a temperature of 100° C., and a process speed of 10 inches per second. The intermediate transfer member comprises Viton B50 (a fluorocarbon elastomer commercially available from E. I. du Pont de Nemours & Co.) of 1.8 mil thickness on a metal substrate.

The percentage transfer of toner from an untreated Viton B50 intermediate transfer member surface is compared to the percentage toner transfer of a Viton B50 intermediate transfer surface treated with a thin film 0.1 to 1 micron coating of Teflon® (polytetrafluoroethylene). The results are shown in Table 1.

TABLE 1

| Coated or Smooth Papers | % Transfer at 100C Untreated Viton B-50 | Level of Coating Pulloff | % Transfer at 100C B50 Viton Treated With Teflon or Fluoropolymer | Level of Coating Pulloff |
|---|---|---|---|---|
| Xerox ISLX | 100 | None | 100 | None |
| Frostbrite Matte 70# | ** | High | 100 | None |
| Productolith Dull 70# | 100 | None | 100 | None |
| Simpson Coated 1 Side | 0 | 0 | 100 | None |
| Productolith Gloss 70# | ** | High | 100 | None |
| Centura Gloss | <100 | Very Low | 100 | None |
| Lustrogloss 70# | ** | High | 100 | None |
| Kromekote 70# | 0 | 100% | 100 | None |

**Denotes spotty transfer, i.e., 100% transfer in some areas and coating pulloff in others.

The results in Table 1 clearly demonstrate that not only is 100% toner transfer achieved by the use of a thin film coating of a release agent material, but also that by the use of a release agent material, a coating upon an image receiving substrate does not transfer to the intermediate transfer member surface, and thus catastrophic failure is avoided.

EXAMPLE 2

A liquid ink developer is made with a resin consisting of a melt blend of poly-1-olefin, specifically poly( 13 wt. %-undecylenic acid-eicosene) copolymer, with 90 wt. % Nucrel 599. The poly-1-olefin is used as an internal release agent for the improved release of the liquid ink developer images from Viton GF intermediate to Kromkote paper, which represents a stress case for transfer and fix of an image.

Other poly-1-olefins of the formula $[—CH_2—CH_2—\{(CH)_{2x}—CH_3\}—]_n$ where x=2, 12, 13 , 15, 17, and ≧ 27, and n refers to the repeat unit specified, and copolymers thereof, can also be used in blends with Nucrel 599. The poly-1-olefin concentration is varied between 1 and 50 wt. % of the resin component of the developer and preferably is between 4 and 10 wt. % as demonstrated herein. Nucrel 599 (90 wt. %) is melt mixed with a poly-1-olefin, specifically 10 wt. % poly(13wt. %-undecylenic acid -87wt. %-eicosene copolymer) using a CSI-mixing extruder at 130° C. The resin blend (20 g), 3 wt. % Witco 22™ (Witco Chemical), 20 wt. % PV Fast Blue™ (Hoechst/Celanese), and Isopar L (170 g, Exxon) are heated in a Union Process 01 attritor containing stainless steel 3/16-inch chrome-coated shot (2400-g) until 200° F. was achieved. After 10 minutes, heating is discontinued and ambient temperature stirring is maintained for 2 hours. Water cooling and stirring is then continued for 4 more hours. The ink is then washed from the shot with approximately 270 g of Isopar L using a strainer, and the weight percent solids of the resultant liquid ink is determined by loss on drying from 6-gram samples heated for 24 hours using a sun lamp.

The ink at 9.2 wt. % solids containing resin (2.77 grams), pigment (P V Fast Blue™, 0.72 gram), charge director (Witco 22™, 0.108 gram), and 91.8% Isopar L™ (35.51 grams) is obtained by concentrating the more dilute ink by centrifugation and exchanging Norpar 15™ dispersant with 3 Isopar L™ washes. The ink is then further diluted to 7.21 wt. % solids with Norpar 15™. The inks at 7.21 wt. % solids are draw-bar coated onto DuPont Viton GF® intermediate and dried in an 80° C. oven for 6 minutes to achieve 50% solids in Norpar 15.

The ink is evaluated by determining transfer and fix to Kromekote papers from Viton GF (a fluorocarbon elastomer available from E. I. dupont de Nemours & Co.) under a nip pressure of 220 psi, a temperature of 100° C., and a process speed of 10 inches per second as follows. Liquid inks prepared with Nucrel 599 (90 wt. %) blended with 10 wt. % poly-1-olefin copolymer resulted in between 90 and 95% image release in transfer and fix to Kromekote paper. This transfer, although not perfect, was substantially improved over toner without the poly-1-olefin.

While this invention has been described in conjunction with specific embodiments thereof, it is evident that many alternatives, modifications, and variations will be apparent to those skilled in the art. Accordingly, it is intended to embrace all such alternatives, modifications and variations that fall within the spirit and scope of the appended claims.

What is claimed is:

1. A method of achieving enhanced toner particle transfer from a surface of an intermediate transfer member of an electrostatographic print machine to an image receiving substrate comprising:

forming a latent image on an imaging member, developing said latent image by contacting the latent image with a liquid developer containing toner particles to form an image comprised of toner particles, electrostatically transferring said image comprised of toner particles from said imaging member to said surface of said intermediate transfer member, and transferring said image comprised of toner particles to said image receiving substrate, wherein said transferring is assisted with a release agent material, said release agent material not forming a part of the intermediate transfer member.

2. A method according to claim 1, wherein said release agent material is incorporated into or coated onto toner particles of said liquid developer.

3. A method according to claim 2, wherein said release agent material is a polyolefin polymer, a polyolefin wax, a fluorinated polymer, a silicone polymer, or a polymer grafted with a polyolefin polymer, a fluorinated polymer or a silicone polymer, or a mixture thereof.

4. A method according to claim 3, wherein said release agent material is a fluorinated or olefin polymer.

5. A method according to claim 4, wherein said fluorinated polymer is polytetrafluoroethylene.

6. A method according to claim 4, wherein said olefin polymer is a poly-1-olefin.

7. A method according to claim 2, wherein said liquid developer further comprises toner particles not containing said release agent material.

8. A method according to claim 1, wherein said image receiving substrate comprises paper or transparent plastic.

9. A method according to claim 1, wherein said release agent material is present as a thin film coating on the surface of said intermediate transfer member.

10. A method according to claim 9, wherein said release agent material is a polyolefin polymer, a polyolefin wax, a fluorinated polymer, a silicone polymer, or a polymer grafted with a polyolefin polymer, a fluorinated polymer or a silicone polymer, or a mixture thereof.

11. A method according to claim 9, wherein said release agent material is a fluorinated polymer.

12. A method according to claim 11, wherein said fluorinated polymer is polytetrafluoroethylene.

13. An electrostatographic printing system comprising an imaging member, an intermediate transfer member and at least one developing station containing a liquid developer and an electrostatic toner image transfer station, where a latent image on said imaging member is developed with a liquid developer containing toner particles, said intermediate transfer member receiving said image comprised of said toner particles from said imaging member and transferring said image comprised of said toner particles to an image receiving substrate, and further comprising a release agent material for aiding transfer of said image to an image receiving substrate, said release agent material not forming a part of the intermediate transfer member structure.

14. An electrostatographic printing system according to claim 13, wherein said release agent material is coated upon the surface of said intermediate transfer member.

15. An electrostatographic printing system according to claim 13, wherein said release agent material is incorporated into or coated upon said toner particles.

16. An electrostatographic printing system according to claims 13, wherein said release agent material is a polyolefin polymer, a polyolefin wax, a fluorinated polymer, a silicone polymer, or a polymer grafted with a polyolefin polymer, a fluorinated polymer or a silicone polymer, or a mixture thereof.

17. An electrostatographic printing system according to claim 16, wherein said release agent material is polytetrafluoroethylene.

18. An electrostatographic printing system according to claim 13, wherein said image receiving substrate comprises paper or transparent plastic.

* * * * *